United States Patent [19]

Kelly

[11] Patent Number: 4,888,930

[45] Date of Patent: Dec. 26, 1989

[54] SEALED ROOF DECK WIND VACUUM TRANSFER SYSTEM

[76] Inventor: Thomas L. Kelly, 31 Sands St., Waterbury, Conn. 06723

[21] Appl. No.: 122,443

[22] Filed: Nov. 19, 1987

[51] Int. Cl.[4] ..... E04B 5/00

[52] U.S. Cl. ..... 52/410; 52/62; 52/309.8; 52/408; 52/420; 52/506

[58] Field of Search ..... 52/309.8, 309.9, 94, 52/199, 394, 436, 408–410, 420, 506, 512, 537, 406, 173 R, 58–62

[56] References Cited

U.S. PATENT DOCUMENTS

| | | | |
|---|---|---|---|
| 2,093,559 | 9/1937 | Hobbie | 52/394 X |
| 2,369,487 | 2/1945 | Ochiltree | 52/394 X |
| 2,781,877 | 2/1957 | Ochiltree | 52/537 X |
| 2,923,386 | 2/1960 | Harry | 52/437 X |
| 3,011,289 | 12/1961 | Ochiltree | 52/420 |
| 3,121,649 | 2/1964 | Oliver | 52/409 X |
| 3,132,446 | 5/1964 | Schleig | 52/537 |
| 3,765,140 | 10/1973 | Harry | 52/208 |
| 4,223,486 | 9/1980 | Kelly | 52/1 |
| 4,557,081 | 12/1985 | Kelly | 52/94 |
| 4,736,552 | 4/1988 | Ward | 52/94 |
| 4,741,132 | 5/1988 | Emblin | 52/58 |

OTHER PUBLICATIONS

Minnesota & Ontario Paper Co., Insulite, pp. 152–154, 2/1954 issue of American Builder.

*Primary Examiner*—David A. Scherbel
*Assistant Examiner*—Andrew Joseph Rudy
*Attorney, Agent, or Firm*—Barnes & Thornburg

[57] ABSTRACT

A sealed roof deck wind vacuum transfer system is disclosed which provides the need for an air seal barrier in a roof assembly by sealing the underlying roof deck panel joints.

30 Claims, 3 Drawing Sheets

SEALED ROOF DECK WIND VACUUM TRANSFER SYSTEM

BACKGROUND AND SUMMARY OF THE INVENTION

The present invention is related to an improved roof assembly of the type utilizing flexible membrane material, preferably single-ply membrane material, as the uppermost part of the roof assembly. More specifically, the present invention is directed to an improved roofing assembly of this type, utilizing air permeable decking comprised of metal sheets, wood decking, concrete planking, and the like. Support metal decking sheets, having corrugations for reinforcement, have been previously used in roofing systems of the type using flexible single-ply membranes. These metal decking sheets are attached to an underlying roof support structure, such as metal I-beams, purlins, joists, a wood frame work, or the like. These metal decking sheets serve to support insulation boards on the top thereof, which insulation boards are then in turn covered by the single-ply membrane. Such metal roof decking sheets are commercially available from U.S. Steel and other suppliers. Air permeable wood decking and concrete planking decking are also readily commercially available through lumber and roofing supply outlets.

In order to accommodate the wind uplift forces that occur in use of such roofing assemblies on a building, especially the very high forces on tall buildings and adjacent perimeter edges of buildings, it has been known to provide venting valves at the membrane. See my U.S. Pat. Nos. 4,223,486 and 4,557,081 for an examples of venting valve systems that have been used. It has also been known to provide some type of sealing envelope that extends over the top of the sheet metal or other air permeable decking and effectively seals the insulation boards in an air-tight envelope when topped by the membrane, in certain areas of the perimeter and protrusions of the roof that is being covered.

In prior systems using single-ply membranes and a poured-in-place concrete deck, the deck serves as an air-tight seal. Flashing is provided between the concrete deck and the membrane overlying the insulation to form a sealed air-tight envelope at protrusions.

In all of the prior systems using some type of vapor barrier or seal placed upon the top of an air permeable decking, the wind uplift forces are transferred to the bottom of the vapor barrier sheet pushing upward from inside the building, and the integrity of the roof system vis-a-vis the wind uplift forces depends upon the integrity of the insulation and the fastener holding capability in the deck to maintain the insulation in place. Typically, the fasteners would penetrate the insulation boards and include an overlying washer-type hold-down member on top of the insulation. These fasteners would then be screwed or bolted to the air permeable decking underneath. Under certain wind uplift conditions, the connection between the insulation board fasteners and the decking can fail during wind uplift stress conditions resulting in the insulation board being pushed against the overlying membrane to cause a roof failure. Prior roofing systems did not employ air seal barriers from the interior of the building including at penetrations, and wind forces would then focus the stress of uplift pressures through the roof assembly directly into the water proofing membrane. These prior systems also required a barrier sheet to be interposed between the top of the decking and the bottom of the insulation board or board layers. This air barrier sheet would also then be penetrated by the fasteners for the hold-down of the insulation boards. Under certain circumstances during assembly of such roofs, the air barrier could tear at the location of the hold-down fasteners, thereby diluting the air barrier effect.

The above described disadvantages are avoided in a very simple manner according to the present invention. According to the present invention, the need for a vapor barrier between the decking and the insulation boards is obviated (i) by providing that the decking panels are sealed along all abutting or overlapping joints; (ii) by providing fasteners for holding the decking on the roof-support structure which are sealed against air leaks through the decking; and (iii) by sealing all perimeter and penetration sections. In especially preferred embodiments, equalizer valves are also provided in areas of concentrated wind lift vortice conditions to cause vacuum transfer into the roof system. Not only does this arrangement obviate the need for an air seal barrier between the insulation board and the air permeable decking, it also assures that the wind uplift stress forces are transferred through the top water proofing membrane and insulation to the decking, thereby relieving the insulation board and fasteners from forces that would otherwise act on them.

One advantageous consequence of the arrangement of the invention is that the insulation board fasteners need provide only minimal support to hold the board against warpage, requiring less fasteners and less sophistication of the fastening scheme for the insulation boards and membrane. It is a rather simple assembly matter to very rigidly fasten the air permeable panel decking to the underlying purlins, joists or the like, in view of the structural integrity of the decking and the purlins, joists or the like. Also, very reliable and repeatable hold-down fastening forces can be maintained between the sheet metal decking and the underlying roof-support purlins, joists, etc. to accommodate the projected wind uplift forces that might occur over particular areas of roof under various wind conditions.

According to certain preferred embodiments of the present invention, each of the fasteners which penetrate the decking are sealed at the penetrations. There are readily available commercial fastener screws and other fasteners which have self-sealing structures so that they form a good air-tight seal without any additional efforts on the part of the roof assembler. The overlapping or abutting joints of the decking sheets are sealed by roof flashing tape or by application of roof caulking according to different preferred embodiments of the invention. The lashing at the edge portions of the field of the roof being covered by the decking can be accomplished in much the same manner as would have been the case with the prior systems, except that additional flashing preferably seals to the edges of the decking. Consequently, this decking flashing connection at the perimeter and protrusion edge portion adds minimum expense and difficulty to the installation process.

Other objects, advantages and novel features of the present invention will become apparent from the following detailed description of the invention when considered in conjunction with the accompanying drawings.

DETAILED DESCRIPTION OF THE DRAWINGS

Figure 1:
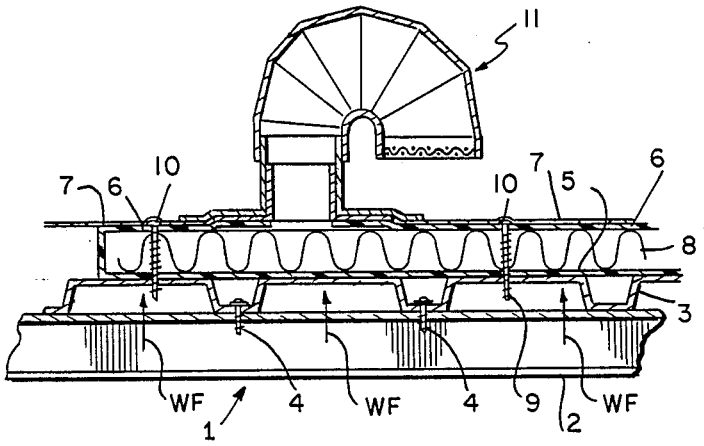
PRIOR ART FIG. 1
FIG. 1 is a cross-sectional schematic view showing an edge portion of a field of a roof covered by a prior art roofing assembly.

FIG. 1 shows a prior art roofing installation of the type which includes roofing-support structure 1, which could be a series of metal purlins 2, which are supported at the side walls and/or other underlying support structure from underneath. Sheet metal decking sheets 3 are connected by fastener screws 4 to the purlins 2. An air seal barrier 5 is interposed above the sheet metal decking 3 and extends upwardly to a flashing connection 6 at a top roof membrane sheet 7. Insulation boards 8 are held in position on top of the air seal barrier 5 by means of roofing fastener screws 9 which have hold-down washer assemblies 10 for holding the insulation board 8 in position. In the prior art arrangement shown in FIG. 1, there is a schematically depicted one-way vent valve 11, which serves to vent high pressure from underneath the membrane 7 and assist in preventing roof membrane blow-off during high wind uplift conditions.

In the arrangement of FIG. 1, the wind uplift forces are effectively applicable at the underside of the air seal barrier membrane 5, as depicted by the arrows for Wind Force (WF). Since the barrier 5 forms an airtight seal underneath the insulation board layer 8, all the forces from the wind uplift WF act on the insulation board hold-down fasteners 9, 10. Thus, if there is a failure at the juncture of the hold-down fasteners 10 at the top of the insulation board, a wind uplift condition can result in lifting of the insulation boards pressing them against the underside of the top membrane 7 and cause a roof failure.

Figure 2:
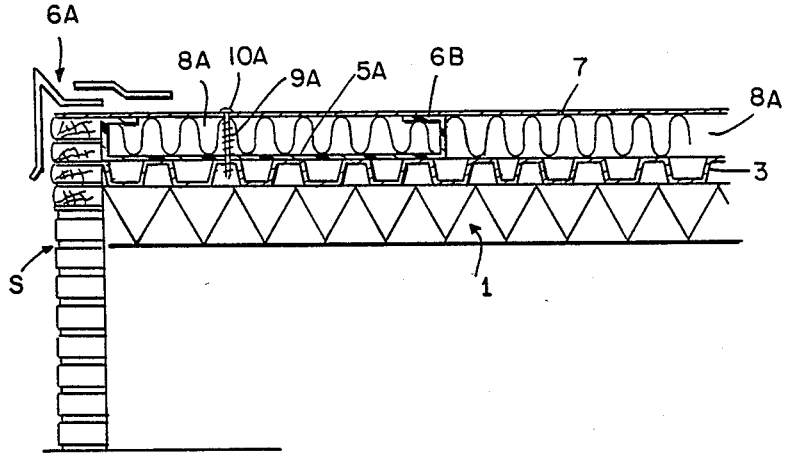
PRIOR ART FIG. 2
FIG. 2 is a view similar to FIG. 1, but showing another prior art assembly.

The FIG. 2 arrangement is quite similar in operation to the FIG. 1 arrangement and also depicts a prior art arrangement where only the perimeter of the roof system is provided with a vapor barrier 5A underneath the insulation boards 8A. As in FIG. 1, the vapor barrier 5A is interposed above the sheet metal decking 3 and below the insulation boards 8A and includes a flashing sealing connection 6A at the edge of the roof and another flashing connection 6B to the roof membrane 7 at a position spaced from the edge of the roof along the joints of respective insulation boards 8A. A one-way vent valve such as vent-valve 11 of FIG. 1 could also be applied in the FIG. 2 arrangement. The wind uplift forces in this FIG. 2 arrangement will also be absorbed at the insulation board fastener 9A, 10A, as described above for the FIG. 1 arrangement.

Figure 3:
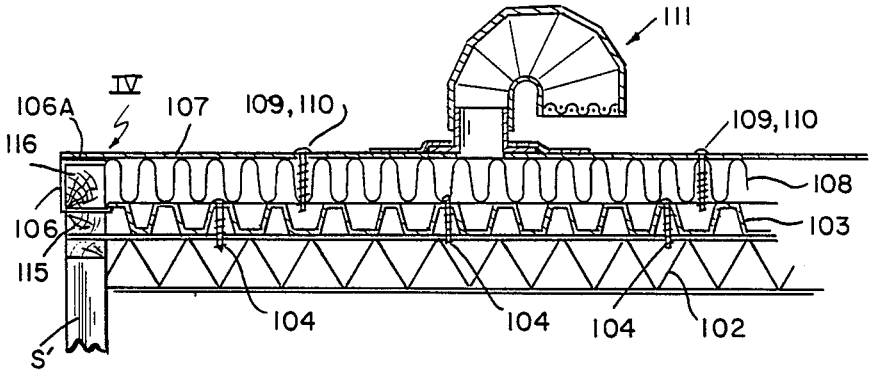
FIG. 3 is a view similar to FIG. 1, but showing a roofing assembly construction in accordance with a preferred embodiment of the present invention.
Figure 5:
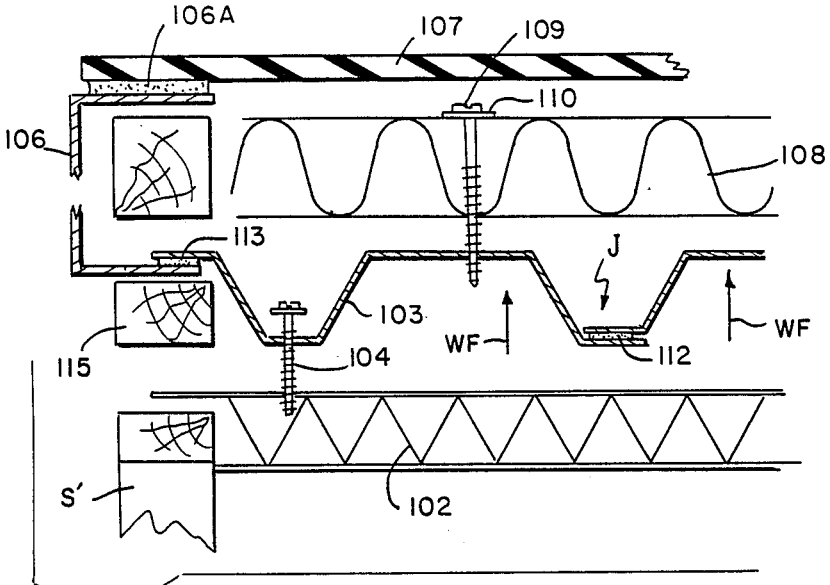
FIG. 5 is an enlarged exploded sectional view of portion V of FIG. 3.

FIG. 3 is a view similar to FIG. 2, schematically depicting a preferred embodiment of the present invention. FIG. 5 is an enlarged exploded detail view of section V of FIG. 3. Referring to FIGS. 3 and 5, sheet metal decking sheets 103 are connected to purlins 102 by means of fastening screws 104. In contrast to the prior art arrangements of FIGS. 1 and 2, there is no vapor barrier interposed on top of the corrugated metal decking 103, but rather the joints J of overlapping metal sheets are provided with sealing caulking 112. Also, the fastening screws 104 are provided with self-sealing material to seal the penetration through the sheets 103. At the edge of the roof section, caulking or flashing sealing 113 is provided which is then connected via flashing sheet 106 and flashing adhesive 106A with the edge of the top roof membrane 107 to form a seal extending from the sheet metal decking to the membrane. In certain preferred embodiments gaskets are used in place of the flashing membrane 106. Thus, the edge is sealed from the top of the side edging board 115, around the insulation abutment edge board 116, to the membrane 107. The sidewalls S' support the entire edge assembly.

The one-way vent valve 111 is preferably provided to vent the space immediately under the membrane 107 to atmosphere, as described above for the embodiment of the prior art arrangement in FIG. 1. My combination of the vent valve and the deck sealing arrangement described herein is especially advantageous in providing a wind uplift resistant roof using economical manufacturing and assembly components and processes. Although very little hold-down forces would be necessary for the insulation boards 108, some type of fasteners 109, 110 can be utilized to hold the insulation boards in place on top of the metal decking.

In the preferred embodiment of the invention shown in FIG. 3, it will be seen that the wind uplift forces WF are now acting underneath the sheet metal decking and therefore are not applied as forces at the fasteners 109, 110 for the insulation boards. Especially in roofing or reroofing projects where the sheet metal decking or other air permeable decking is being replaced or installed new, it is a relatively simple matter to provide the air-tight seal directly at the decking in a reliable manner. Consequently, in a very simple manner, the present invention obviates the need for the additional vapor barrier underneath the insulation boards and also provides for a transfer of the hold-down forces to the connection between the sheet metal decking and the underlying purlins, joists, etc., a location where reliable fastening can be made because of the uniformity and the rigidity and strength of the decking, as contrasted with the insulation boards which are not designed to be able to withstand very much fastening force due to their fragile and/or brittle nature.

Figure 4:
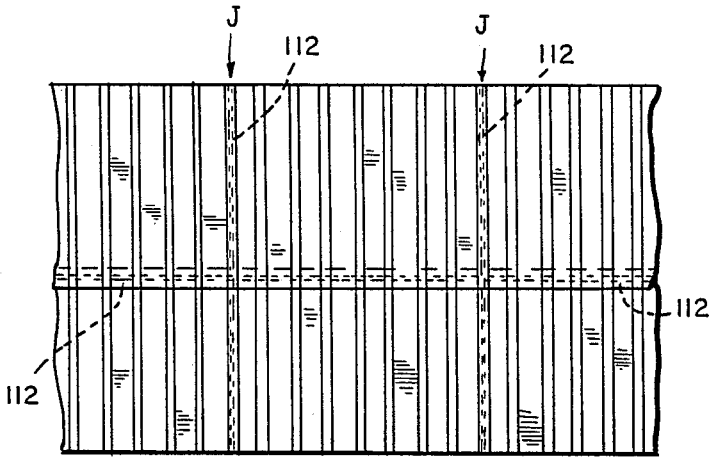
FIG. 4 is a partial, schematic, top view taken along the line IV—IV of FIG. 3.
Figure 6:
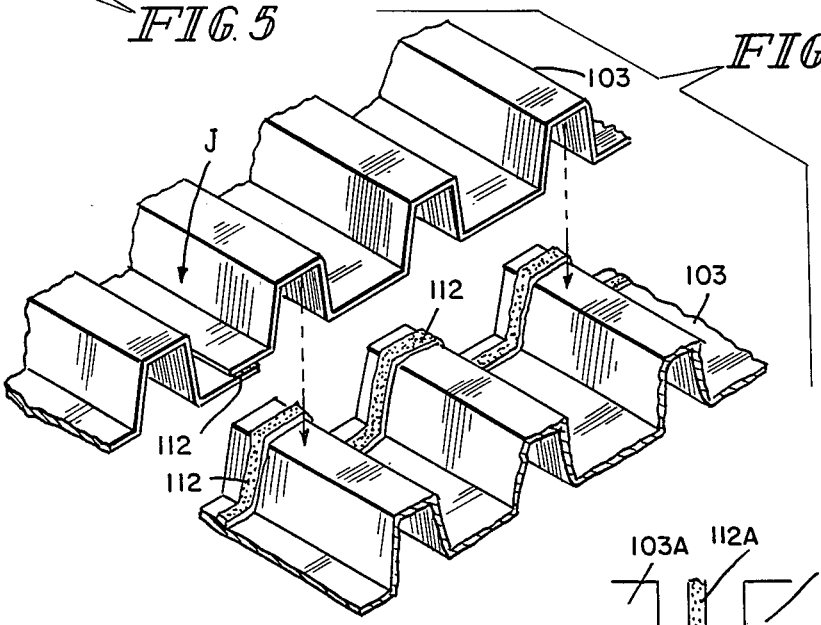
FIG. 6 is a schematic partial exploded view from above depicting a sealing arrangement for decking sheets constructed in accordance with a preferred embodiment of the invention.

FIG. 4 schematically depicts the pattern of the caulking and/or the sealing points 112 that need to be applied to the joints J to make the sheet metal decking an airtight seal according to the invention. FIG. 6 schematically depicts the caulking 112 applied at the joints of overlapping sheet metal decking sheets.

Figure 7:
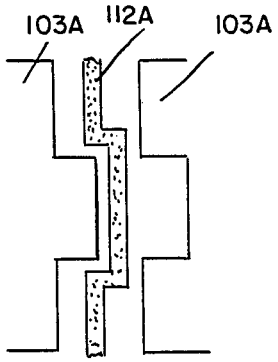
FIG. 7 is an exploded top view depicting a sealing arrangement for decking panels constructed in accordance with another preferred embodiment of the invention.

FIG. 7 schematically depicts another embodiment with sheet metal decking sheets 103A being sealed at abutting edges by sealing gasket 112A. A similar sealing gasket arrangement could be used for concrete planking decking or wood planking decking.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A roofing assembly for a building roof or the like, comprising:

roof-support structure means;

air permeable deck means overlying and supported on the roof-support means, said deck means including a plurality of separate roof deck panels which overlap or abut at deck joints along their respective edge portions when assembled;

insulation board means supported on top of the roof deck panels;

flexible water-tight membrane means overlying the insulation board means; and deck sealing means for sealing all areas of the deck means, said deck sealing means including means for sealing all abutting or overlapping joints between the roof deck panels and means for sealing all perimeters and penetration sections so as to form an air-tight seal at the deck means between the respective areas above and below the deck means to thereby effect the transfer of wind uplift forces to the deck means.

2. An assembly according in claim 1, further comprising equalizer valve means arranged to vent the space under the membrane means to atmosphere.

3. An assembly according to claim 2, wherein said deck means is made of metal with said roof deck panels being corrugated sheet metal roof deck panels.

4. An assembly according to claim 3, wherein said sheet metal roof deck panels include adhesive for adhering the panels to the roof support structure means.

5. An assembly according to claim 4, wherein said deck sealing means includes sealing material preapplied to edges of sheet metal panels before assembly on a roof.

6. An assembly according to claim 3, wherein said deck sealing means includes flashing means for sealing the periphery and protrusion of the section of the roof being covered by the roof deck panels, said flashing means extending from the roof deck panels to the membrane means to form an air-tight seal between the membrane means and the roof deck panels.

7. An assembly according to claim 1, wherein said roof deck panels overlap one another along adjacent respective edges when assembled on a roof, and wherein said deck sealing means includes sealing caulking applied between the overlapping roof deck panels.

8. An assembly according to claim 1, wherein fastener means are provided for holding the roof deck panels onto the roof support structure means, said fastener means penetrating the roof deck panels, and wherein said deck sealing means includes self-sealing means at each of the fastener means.

9. An assembly according to claim 1, wherein said deck sealing means includes flashing tape means applied to joints between the roof deck panels.

10. An assembly according to claim 1, wherein said roof deck panels abut one another along adjacent respective edges when assembled on a roof, and wherein said deck sealing means includes sealing caulking applied between the abutting roof deck panels.

11. An assembly according to claim 1, wherein said deck sealing means includes sealing tape preapplied to the respective joint forming edges of the roof deck panels before assembly on a roof.

12. An assembly according to claim 1, wherein said deck sealing means includes sealing caulking preapplied to respective joint forming edges of the roof deck panels before assembly on a roof.

13. An assembly according to claim 1, wherein said deck sealing means includes flashing means for sealing the periphery and protrusions of the section of the roof being covered by the roof deck panels, said flashing means extending from the roof deck panels to underneath the membrane means to form an air-tight seal between the membrane means and the roof deck panels.

14. An assembly according to claim 10, wherein said flashing means includes preformed gasket means for effecting sealed side edge connections between the top of the roof membrane means and the underside of the roof deck panels.

15. An assembly according to claim 14, wherein said gasket means is made of sponge.

16. An assembly according to claim 14, wherein said gasket means is made of preformed metal.

17. An assembly according to claim 14, wherein said gasket means is made of preformed wood.

18. An assembly according to claim 14, wherein said gasket means comprises rubber or the like material and caulking adhesive holding the same in place.

19. An assembly according to claim 14, wherein the gasket means is formed of flashing membrane compatible with the roof membrane means.

20. An assembly according to claim 14, wherein the gasket means is on extension of the roof membrane means itself which extends to the deck means.

21. An assembly according to claim 1, wherein said roof membrane means is made of single ply polyvinyl chloride sheeting.

22. An assembly according to claim 1, wherein said assembly comprises polyethylene wrapped panels.

23. An assembly according to claim 1, wherein said fastener means are provided for holding the roof deck panels onto the roof support structure means, said fastener means penetrating the roof deck panels.

24. An assembly according to claim 1, wherein said deck sealing means include flashing tape means interposed between upper and lower overlapping edges forming joints between the roof deck panels.

25. An assembly according to claim 1, wherein said roof deck panels are made of concrete planking.

26. An assembly according to claim 1, wherein said roof deck panels are made of one gypsum, tectum, composite material and wood.

27. An assembly according to claim 1, wherein said roof membrane means is made of single ply elastomeric rubber and plastomeric sheets.

28. An assembly according to claim 1, wherein said sealing means includes caulking applied to respective abutting or overlapping joints between the roof deck panels.

29. An assembly according to claim 1, wherein said sealing means includes tape applied to the roof deck panels at abutting or overlapping joints between the roof deck panels.

30. An assembly according to claim 1, wherein said sealing means includes gasket means.

* * * * *